United States Patent [19]

Schultz

[11] 4,341,305

[45] Jul. 27, 1982

[54] CONTAINER FOR STORING SHAVING BLADE UNITS

[75] Inventor: Erhard Schultz, Solingen, Fed. Rep. of Germany

[73] Assignee: Tondeo-Werk GmbH, Solingen, Fed. Rep. of Germany

[21] Appl. No.: 183,831

[22] Filed: Sep. 3, 1980

[30] Foreign Application Priority Data

Sep. 7, 1979 [DE] Fed. Rep. of Germany ..... 2936167

[51] Int. Cl.[3] ..... B65D 83/10

[52] U.S. Cl. ..... 206/356; 206/354

[58] Field of Search ..... 206/352, 354, 355, 356, 206/357, 358

[56] References Cited

U.S. PATENT DOCUMENTS

| | | | |
|---|---|---|---|
| 3,244,317 | 4/1966 | Raybin | 206/355 |
| 3,834,018 | 9/1974 | Dawidowicz et al. | 206/356 |
| 3,880,284 | 4/1975 | Pomfret | 206/354 |
| 3,941,243 | 3/1976 | Yamada | 206/356 |
| 3,977,565 | 8/1976 | Muller | 206/357 |
| 4,106,620 | 8/1978 | Brimmer et al. | 206/356 |
| 4,157,758 | 6/1979 | Kozlowski, Jr. | 206/352 |
| 4,180,162 | 12/1979 | Magney | 206/356 |

FOREIGN PATENT DOCUMENTS

| | | | |
|---|---|---|---|
| 890306 | 11/1943 | France | 206/352 |

*Primary Examiner*—Joseph Man-Fu Moy
*Attorney, Agent, or Firm*—Michael J. Striker

[57] ABSTRACT

A container for storing of shaving blade units each including an elongated blade and a holding element embracing the same, has a body portion with at least one elongated compartment and an abutment member bounding the compartment at one side of one transverse dimension, wherein the one transverse dimension of the compartment is such that the cutting edge of the blade in inserted condition of the shaving blade unit abuts against the abutting member, and the other transverse dimension is such that a small space remains in the compartment to the shaving unit in direction of the other dimension.

10 Claims, 7 Drawing Figures

Fig.1
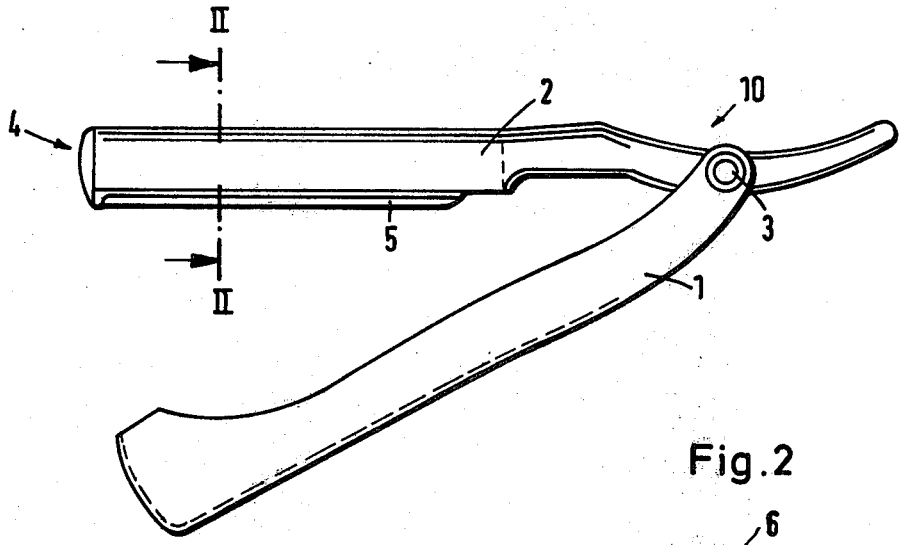
Fig.2
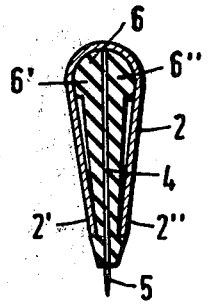
Fig. 3
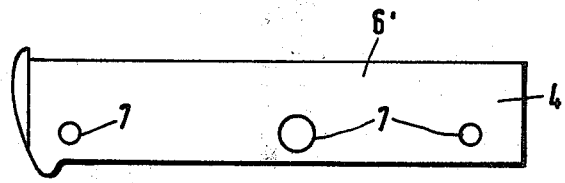
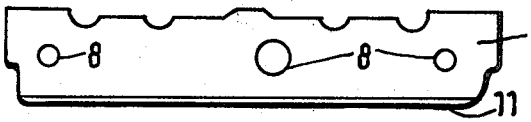
Fig.4
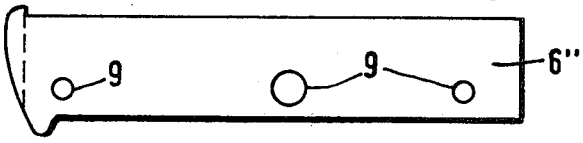
Fig.5
Fig.6
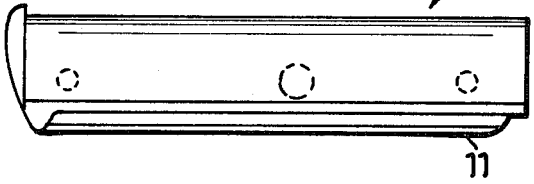

CONTAINER FOR STORING SHAVING BLADE UNITS

BACKGROUND OF THE INVENTION

The present invention relates to a container for storing of shaving blade units. More particularly, it relates to a container for storing of a shaving blade unit which comprises a blade provided with a cutting edge and a holding element.

Shaving blade units of the above-mentioned general type are known in the art. One of such units is disclosed in the German Offenlegungsschrift No. 1,553,829. The blade of the unit disclosed here is a half of a razor blade which is broken in direction along its longitudinal center line. The holding element is strip shaped and includes two strips which are pivotally connected at their one end and embrace the blade in folded condition of the strips. The entire unit can be inserted into a U-shaped sheet blade holder which is pivotally connected at its other end with a handle whereby a razor-like shaving device is obtained.

The above-described shaving device is utilized in such a manner that the blade holding elements together with the handle or the blade holder are supplied as shaving devices, whereas the blades must be separately obtained in packets. The user must then break the blade into two half blades, and connect one half blade with the blade holding element in the shaving blade unit inserted in its handle. This process requires considerable attentiveness, inasmuch as the sharp edge of the blade can easily lead to cut injuries.

It has been further proposed to supply the blade with the blade holding element as prefabricated and inseparable shaving blade unit so that the user must only insert it into the handle, and throw away the same after utilization. In this case, packing in packets cannot be considered inasmuch as the shaving blade units have a certain thickness.

SUMMARY OF THE INVENTION

Accordingly, it is an object of the present invention to provide a container for storing of shaving blade units, which avoids the disadvantages of the prior art.

More particularly, it is an object of the present invention to provide a container for storing of shaving blade units which allows insertion of the shaving blade units into the blade holders.

In keeping with these objects and with others which will become apparent hereinafter, one feature of the present invention resides, briefly stated, in a container which has a body portion with a compartment, wherein a compartment is elongated so that a shaving blade unit can be inserted into the compartment through an opening thereof, an abutment member bounds the compartment at one side of its one transverse dimension, the one transverse dimension is such that a cutting edge of the blade abuts against the abutting member, and the other transverse dimension of the compartment is such that a small space remains in the compartment to the shaving blade unit inserted therein.

When the container is designed in accordance with the present invention, the shaving blade unit is inserted in the container so that its cutting edge faces toward and abuts against the abutment member constituted of synthetic plastic material. By the respective dimensioning of the compartment in the container, the shaving blade unit rests on the bottom of the compartment, and at the same time its cutting edge abuts against the synthetic plastic material with a certain pressure. Thereby, unintentional withdrawal of the shaving blade unit from the compartment is prevented. The height of the compartment is selected in accordance with the above mentioned consideration. The lateral distance between the inner walls of the compartment and the shaving blade unit is so selected that the blade holder can be inserted into the compartment from its open end so as to fit onto the shaving blade unit accommodated in the compartment. At the same time, because of the wall thickness of the blade holder, a ridge of the cutting edge of the shaving blade unit is pressed stronger into the synthetic plastic material.

Thus, there is a possibility of moving of the blade holder onto the shaving blade unit accommodated in the compartment. Thereby, a certain guidance is provided during such movement, so that no shift is possible which takes place when the shaving blade unit is inserted into the blade holder by hand. As a result of this, the danger of cutting is considerably reduced. The shaving blade unit is enclosed at its all sides in the container first when the blade holder is completely fitted onto the shaving blade unit, and then when it is withdrawn from the compartment ready to use.

In the process of the above-mentioned withdrawal, additional advantages are obtained in accordance with the present invention. The cutting edge is pulled during this withdrawal, through the synthetic plastic material. The blades in question having a coating of polytetrafluorethylene or similar material so as to improve sliding characteristics of the same. In the process of shaving, this material is brought onto the cutting edge so that it covers the cutting edge and particularly its working region. In normal shaving blades this coating, because of the high surface pressure, is transferred to the rear during the shaving process so that the cutting edge becomes free of the same. When, however, such a shaving blade unit is utilized as an auxiliary instrument for hair cutting, the coating is not removed from the working region of the cutting edge and its cutting action cannot be completely restored inasmuch as the counter pressure is not so high as during shaving and water accommodated between wet hair contributes to mere oversliding of the cutting edge.

When the shaving blade unit abuts against or is somewhat inserted into the synthetic plastic material, the coating is easily removed from the cutting edge during pulling of the shaving blade unit from the compartment of the container, so that the cutting edge again sufficiently performs its intended functions.

The shaving blade unit is inserted into the compartment so that the width of the blade extends in a vertical direction. The vertical dimension of the compartment is insignificantly smaller than the widths of the blade with the cutting edge. The abutment member may be constituted of foamed polystyrene or a similar material which is lighter and harder than the foamed polystyrene.

In accordance with another feature of the present invention, the abutment member is plate-shaped. A plurality of compartments for accommodating a plurality of the shaving units may be provided. In this case, it is advantageous when the abutment member is formed as a plate which simultaneously bounds all compartments of the container.

In accordance with a further advantageous feature of the present invention, the body portion is subdivided into two body parts in a plane which extends parallel to the plane of the plate-shaped abutment member. The body parts are connectible with one another, for example, by interengaging formations provided on both body parts of the container.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWINGS

FIG. 1 is a view showing a shaving blade device;

FIG. 2 is an enlarged view showing a section of the device, taken along the line II—II in FIG. 1;

FIGS. 3–5 are views showing parts of a shaving blade unit;

FIG. 6 is a view showing the shaving blade unit in assembled condition; and

DESCRIPTION OF A PREFERRED EMBODIMENT

Figure 7:
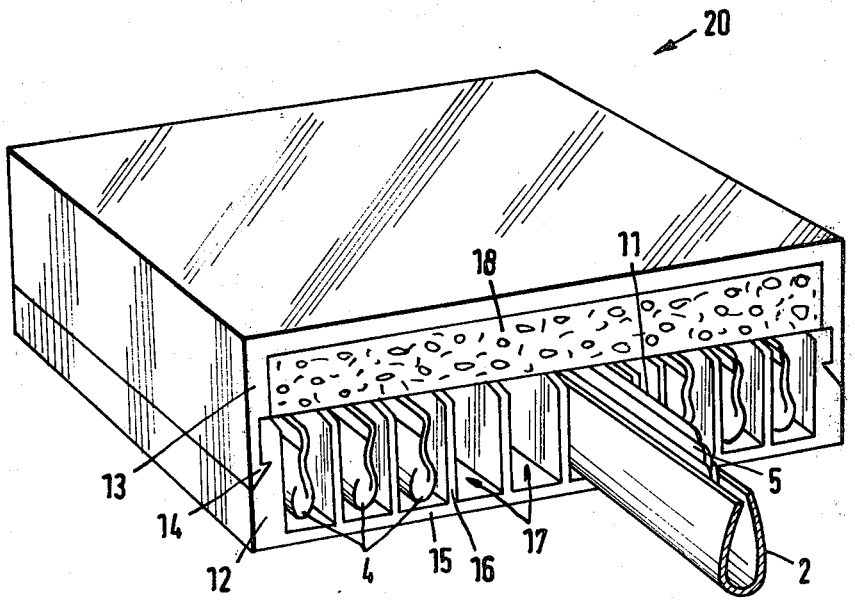
FIG. 7 is a perspective view showing a container for storing of the shaving blade units, in accordance with the present invention.

As can be seen from FIG. 1, a shaving and hair cutting device is identified by reference numeral 10 and formed as a razor. The shaving and hair cutting device 10 comprises a handle 1 and a blade holder 2 connected with the handle 1 by a hinge 3. The blade holder 2 has a continuous U-shaped cross section in its front part, as can be seen from FIG. 2.

A shaving blade unit is identified by reference numeral 4 and inserted from the left side in FIG. 1 into the blade holder 2. The shaving blade unit includes a blade which is identified by reference numeral 5 and extends downwardly beyond the blade holder 2, out of the open side of the latter.

The blade 5 is held in a blade holding element 6 which includes two strip shaped holding members 6′ shown in FIG. 3 and 6″ shown in FIG. 5. The blade holding members 6′ and 6″ embrace the blade 5 at both sides of the latter.

The blade holding member 6′ is provided with pins 7 which are arranged at a surface which faces toward the blade 5. The pins 7 extend through respective openings 8 of the blade 5 and engage in openings 9 of the blade holding member 6″. Thereby, the blade 5 is embedded in sandwich-like manner between the blade holding members 6′ and 6″. Only a cutting edge 11 projects downwardly beyond the thus formed sandwich.

The pins 7 can be secured in the openings 9 by welding or other mechanical methods, so as to form the undetachable shaving blade unit 4 which is shown in FIG. 6. The shaving blade unit 4 is inserted in the blade holder 2. The latter has legs 2′ and 2″ which abut against the lateral faces of the shaving blade unit 4 with prestress.

In order to reliably store the shaving blade units 4 and unite the same with the blade holder 2, a storing container is provided. This container is shown in FIG. 7 and identified by reference numeral 20. The container is substantially box-shaped and includes a lower part 12 and an upper part 13. The lower part 12 and the upper part 13 can be connected with one another with the aid of engaging formations 14 under the action of pressure.

The lower part 12 has a bottom 15 and a plurality of partitions 16 which extend upright and parallel to one another from the bottom. The partitions 16 form therebetween a plurality of small compartments 17. The compartments 17 have a length corresponding to the length of the shaving blade units 4. The shaving blade units 4 can be inserted into the compartments 17 in upright position.

The lower part 12 is open upwardly, and its open side is bridged by a plate 18 of foamed polystyrene. The plate 18 is arranged in the upper part 13. The height of the compartments 17 is so selected that the shaving blade units 4 are tightly inserted into the compartments and abut against the bottom 15 and the plate 18. Thereby, the shaving blade units cannot be unintentionally withdrawn from the compartments.

At the sides of each shaving blade unit, an intermediate space remains in the respective compartments. Thereby, the blade holder which is shown in FIG. 7 only in its front part and broken in its remaining part, can be inserted into the compartment from the front side so as to engage the shaving blade unit 4. The shaving blade unit 4 is then completely embraced by the blade holder as shown in FIG. 1.

Because of the wall thickness of the blade holder 2, the blade 5 with its cutting edge 11 is somewhat stronger pressed against the plate 18 during the insertion of the blade holder 2. Thereby, when the blade holder 2 with the shaving blade unit 4 is withdrawn from the compartment, the cutting edge 11 moves over the foamed polystyrene under pressure and undesirable coating of polytetrafluorethylene or the like is removed from the cutting edge 11.

The container 20 is subdivided into two parts 12 and 13 along a plane which extends parallel to the plane of the plate 18. In such a construction, during the manufacture, the shaving blade units 4 are inserted into the lower part 12 from above, and then the upper part 13 with the plate 18 are placed onto the lower part 12 and the shaving blade units 4 accommodated in the latter. This considerably facilitates the filling of the container 20. Although it is not necessary for holding of the shaving blade units 4, the container 20 after its filling can be surrounded by a foil or another packing material for hygiene purposes.

It will be understood that each of the elements described above, or two or more together, may also find a useful application in other types of constructions differing from the types described above.

While the invention has been illustrated and described as embodied in a container for storing shaving blade units, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected be Letters Patent is set forth in the appended claims:

1. A container for storing of shaving blade units each including an elongated blade having a coating and a cutting edge extending along a longitudinal face of the blade and a holding element embracing the blade at lateral sides of the latter, the storage container comprising a body portion having at least one elongated compartment having a length, a height and a width, said compartment having two ends spaced from one another in direction of elongation and an opening at one of said ends so that the shaving blade unit can be inserted into said compartment through said opening and a width of the blade extends in direction of the height of said compartment, the width of said compartment being such that in inserted condition of the shaving blade unit a small space remains in said compartment to the shaving blade unit in direction of the width of said compartment; and an abutment member limiting said compartment at its one side as considered in direction of its height, the height of said compartment being such that in inserted condition of the shaving blade unit the cutting edge of the blade at least abuts against said abutment member, and said abutment member being composed of such a material that during withdrawal of the shaving blade unit from said compartment the coating of the blade is removed from the cutting edge of the blade.

2. A container as defined in claim 1, wherein the height of said compartment is insignificantly smaller than the width of the blade of the shaving blade unit so that in the inserted condition the cutting blade of the shaving blade unit is somewhat inserted into said abutment member, and during the withdrawal of the shaving blade unit from the cutting edge of the blade moves through said abutment member.

3. A container as defined in claim 1, wherein the blade has lateral faces, and the holding element is U-shaped and embraces the lateral faces of the blade; and further comprising a holder embracing the holding element, said space in direction of the width being such that after insertion of the shaving blade unit into said compartment, the holder can also be inserted into said compartment in engagement with the shaving blade unit.

4. A container as defined in claim 1, wherein said abutment member is constituted of foamed polystyrene.

5. A container as defined in claim 1, wherein said abutment member is constituted of a material which is lighter than foamed polystyrene and harder than the latter.

6. A container as defined in claim 1, wherein said body portion has a plurality of such compartments, said abutment member extending over and limiting said plurality of compartments at said one side.

7. A container as defined in claim 1, wherein said abutment member is plate-shaped.

8. A container as defined in claim 7, wherein said plate-shaped abutment member extends in a predetermined plane, said body portion being subdivided into two body parts in a plane extending parallel to the plane of said plate-shaped abutment member, said body parts being connectible with one another in said parallel plane.

9. A container as defined in claim 8; and further comprising means for connecting said body parts of said body portion in said parallel plane, said connecting means including interengaging formations provided on one of said body parts and on the other of said body parts.

10. A container is defined in claim 1, wherein the coating of the blade is composed of polytetrafluoroethylene, said abutment member being composed of a material which removes the polytetrafluoroethylene coating from the cutting edge during the withdrawal of said shaving blade unit from said compartment.

* * * * *